United States Patent [19]

Estes

[11] Patent Number: 4,962,574

[45] Date of Patent: Oct. 16, 1990

[54] PLURAL DISPLAY CASKET

[76] Inventor: John W. Estes, P.O. Box 339, Osawatomie, Kans. 66064

[21] Appl. No.: 461,415

[22] Filed: Jan. 5, 1990

[51] Int. Cl.[5] ..... A61G 17/00

[52] U.S. Cl. ..... 27/2; 27/16; 27/19

[58] Field of Search ..... 27/2, 7, 14–16, 27/19

[56] References Cited

U.S. PATENT DOCUMENTS

| | | | |
|---|---|---|---|
| 999,549 | 6/1911 | Mowen | 27/14 |
| 2,042,849 | 6/1936 | Jacques | 27/14 X |
| 3,233,302 | 2/1966 | Ross . | |
| 3,283,386 | 11/1966 | Cenegy . | |
| 4,312,104 | 1/1982 | Baker et al. . | |
| 4,357,741 | 11/1982 | Winburn et al. . | |
| 4,688,305 | 8/1987 | MacKirdy | 27/16 |

*Primary Examiner*—Richard E. Chilcot, Jr.

*Attorney, Agent, or Firm*—D. A. N. Chase; Joan Optican Herman

[57] ABSTRACT

A plural display burial casket utilizes two substantially equal top portions which are hingedly attached to opposed sides of a casket body. The top portions utilize quick release mechanisms which allow the top portion acting as the unselected foot end of the casket to be expediently turned aside during casketing procedures. The unselected top portion is then returned to its original position. The casket is adapted to be either a protective type or non-protective type casket.

8 Claims, 3 Drawing Sheets

PLURAL DISPLAY CASKET

BACKGROUND OF THE INVENTION

This invention relates to a burial casket, and more specifically to a burial casket designed to have two different interior styles or colors within the same casket.

Funeral merchandising is often a space consuming and expensive undertaking. Funeral directors must maintain a large inventory of burial caskets for display as well as for storage purposes. The inventory expense and the storage space required for this are undesirable. Burial caskets having a variety of different interior upholstery designs must be included in the inventory of a funeral director. Specifically, it is essential for the funeral directors to maintain in their inventory burial caskets having interiors which are suitable for either men or women.

Attempts have been made in the past to provide a plural display casket. However, such attempts have not been satisfactory. Most of these previous efforts resulted in a casket having a segmented top, each of the segments opening in the same direction and having interior upholstery to the left which is different from the interior upholstery to the right. Tradition, however, requires that the deceased be casketed only with the head to the left. Another casket had a segmented top which opened in different directions, but which had no provisions for expediently casketing the deceased. For this reason, previous attempts at marketing plural display-type caskets have been negligible and unsuccessful.

SUMMARY OF THE INVENTION

It is, therefore, the primary object of the present invention to provide a burial casket having plural display capabilities which will reduce the number of caskets a funeral director must retain in inventory, thereby reducing fixed asset investments in required storage and floor display space, and decreasing investments in display models.

It is a further object of the present invention to provide a casket as aforesaid, wherein the merchandise selection of funeral homes is enhanced through increased versatility of products.

It is another object of the present invention to provide a casket as aforesaid which has a segmented top, each of said segments opening in different directions so that the head of the deceased will always be casketed to the left of the viewer.

It is a further object of the present invention to provide a casket as aforesaid which has a segmented top, wherein said casket can be either a protective type or a non-protective type casket.

It is still another object of the present invention to provide a casket as aforesaid wherein the unselected top segment being utilized as the foot end of the casket can be expediently turned aside to permit the body of the deceased to be casketed, and can then be expediently returned to its original position.

The present invention provides a casket having a top divided into two essentially equal portions divided by a bridge cut, each of the portions hingedly opening in different directions, so that when the selected portion of the top is opened to display the deceased, the opened portion will be on the viewer's left of the casket. Each of the portions can be provided with different interior upholstery designs, so that one casket can be provided with both feminine and masculine interiors.

The selected top portion which opens allowing the head of the deceased to be viewed to the left of the casket is known as the head end, while the other unselected portion is known as the foot end. Each of the portions are connected to the structural body of the casket and are provided with quick release mechanisms so that they are capable of being partially unsecured from the casket body, and then pivoted to the side. In this manner, the unselected top portion at the foot end of the casket may be expediently turned aside until it is perpendicular to the longitudinal axis of the casket, in order to permit casketing of the deceased. After the deceased is in place, this top portion is then returned to its original position.

The casket may further be provided with a gasket assembly comprising a main body gasket, and a removable bridge gasket cross member having a bridge gasket thereon that is removed during casketing of the body, and replaced when the body is in place. The bridge gasket on the cross member effects a seal at the bridge cut of the tops. The main body gasket is affixed to the perimeter of the casket body. The bridge gasket and cross member are used when it is desired to have a protective type casket, and may be omitted when a non-protective type casket is desired.

Other objects and advantages of this invention will become apparent from the following description taken in connection with the accompanying drawings, wherein is set forth by way of illustration and example, an embodiment of this invention.

DESCRIPTION OF THE PREFERRED EMBODIMENT

Figure 1:
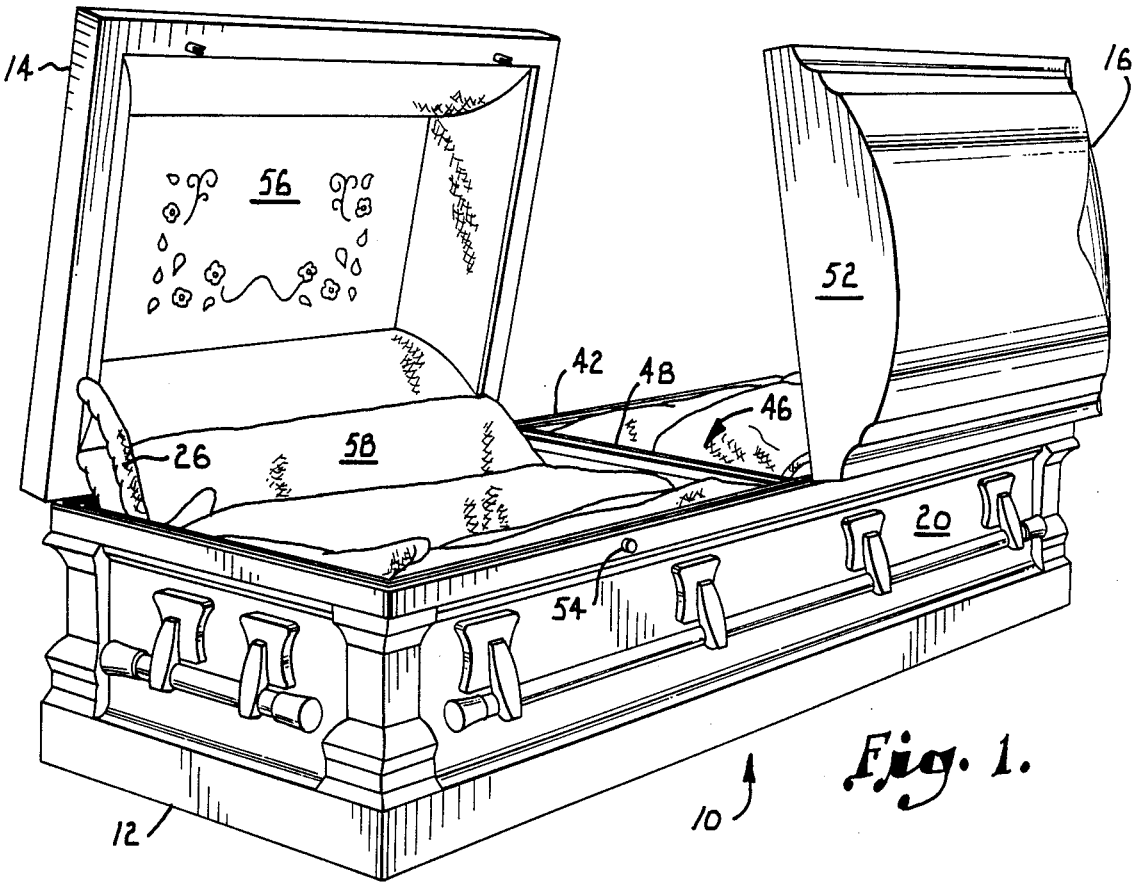
FIG. 1 is a perspective view of the plural display casket, with both top portions of the casket in an opened position.

Referring now to FIG. 1, a burial casket is presented and is generally referred to as 10, said burial casket 10 having an essentially rectangular structural body portion 12 and two substantially equal top portions 14 and 16 attached thereto. Top portions 14 and 16 are separated by a relatively narrow bridge cut which is an elongated void extending transversely across the longitudinal axis of structural body portion 12. Top portion 14 is attached to side 18 of the body portion 12, and top portion 16 is attached to side 20 of the body portion 12. As can be seen in the drawings, the top portions 14 and 16 are attached on opposite sides 18 and 20, respectively, of the structural body 12, and thereby open in opposing directions. As is traditional in the burial industry, the top portions 14 and 16 are designed so that when the selected top portion 14 or 16 is opened, the deceased is casketed only with the head to the left and the feet to the right. Thus the industry refers to the ends of the casket as the head end and the foot end. In FIG. 1, selected top portion 14 is positioned at the head end, and unselected top portion 16 is positioned at the foot end. Similarly, in FIG. 2, selected top portion 16 is positioned at the head end, and unselected top portion 14 is positioned at the foot end.

The top portions 14 and 16 are attached to the body portion 12 by a quick release mechanism which is comprised of swing hinge means 22, pivot hinge means 24, and top support means 26. This quick release mechanism allows the unselected top portion 14 or 16 acting as the foot end to be temporarily partially detached from the body potion 12 in order to swing the unselected top portion 14 or 16 across the body portion 12 to a position perpendicular to the longitudinal axis of the body portion 12, as can be seen by the position of the unselected top portion 14 in FIG. 2, and by the unselected top portion 14 or 16 in FIG. 3. This swing action moves the unselected top portion 14 or 16 out of the way during the casketing procedure. The partially detached top portion 14 or 16 can then be easily re-attached, as discussed below.

Figure 8:
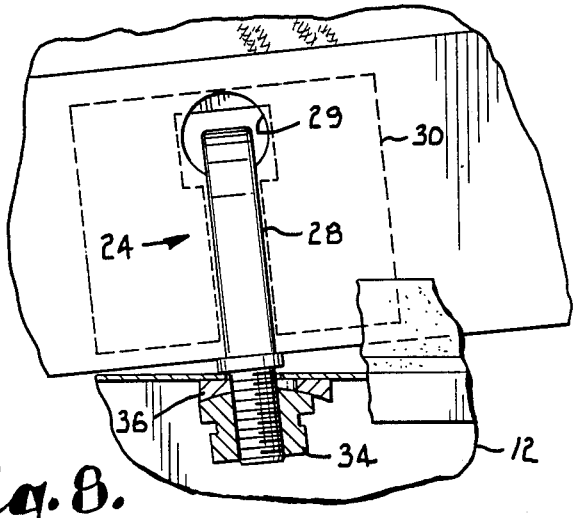
FIG. 8 is an enlarged fragmentary cross-section taken along line 8—8 of FIG. 3, showing the pivot hinge mechanism in greater detail.

The swing hinge means 22 (the hinge means nearest the center of the casket 10) and the pivot hinge means 24 (the hinge means nearest the outer end of the casket 10) in the preferred embodiment are identical, although the method used to fasten each hinge 22 and 24 to the casket body 12 are different. Hinge means 22 and 24 are both comprised of an essentially U-shaped arm 28 rotatably attached to a pivot plate 30 which is secured within the top portion 14 or 16. The arm 28 extends through an opening 29 in the top portion 14 or 16 and through an opening 31 in the body portion 12 and is selectively secured thereto. In the swing hinge means 22 of the preferred embodiment, the means selectively securing the swing hinge 22 to the body portion 12 consists of a knurled finger nut 32 which is manually removable to allow the unselected top portion 14 or 16 to be temporarily detached and to swing across the body portion 12, out of the way during the casketing procedure. The means securing the pivot hinge means 24 to the body portion 12 can be appreciated from FIG. 8, where a spherical nut 34 and washer 36 combination secures the pivot hinge means 24 to the body portion 12. This combination compensates for misalignment of the pivot hinge means 24 when the swing hinge means 22 is lifted from the body portion 12 and the unselected top portion 14 or 16 is turned aside. The spherical nut 34 and washer 36 perform like a ball and socket during misalignment and when turned.

The top support means 26 is generally covered by upholstery which can be selectively retracted. The top support means 26 can be appreciated from FIGS. 3 and 5, and in the preferred embodiment is comprised of a knee brace. The quick release mechanism of the top support means 26 consists of a quick release, self-locking pin 38 held in place by a steel bracket 40 welded beneath the gasket molding 43 on the body portion 12 of the casket 10. The top support 26 is retained in position by a spring-loaded detent ball 44 in the quick release pin 38. Extra pressure must be applied to the detent ball 44 when releasing the top support 26. The phantom lines in FIG. 3 show the top support means 26 in an unsecured position.

Figures 3, 5:
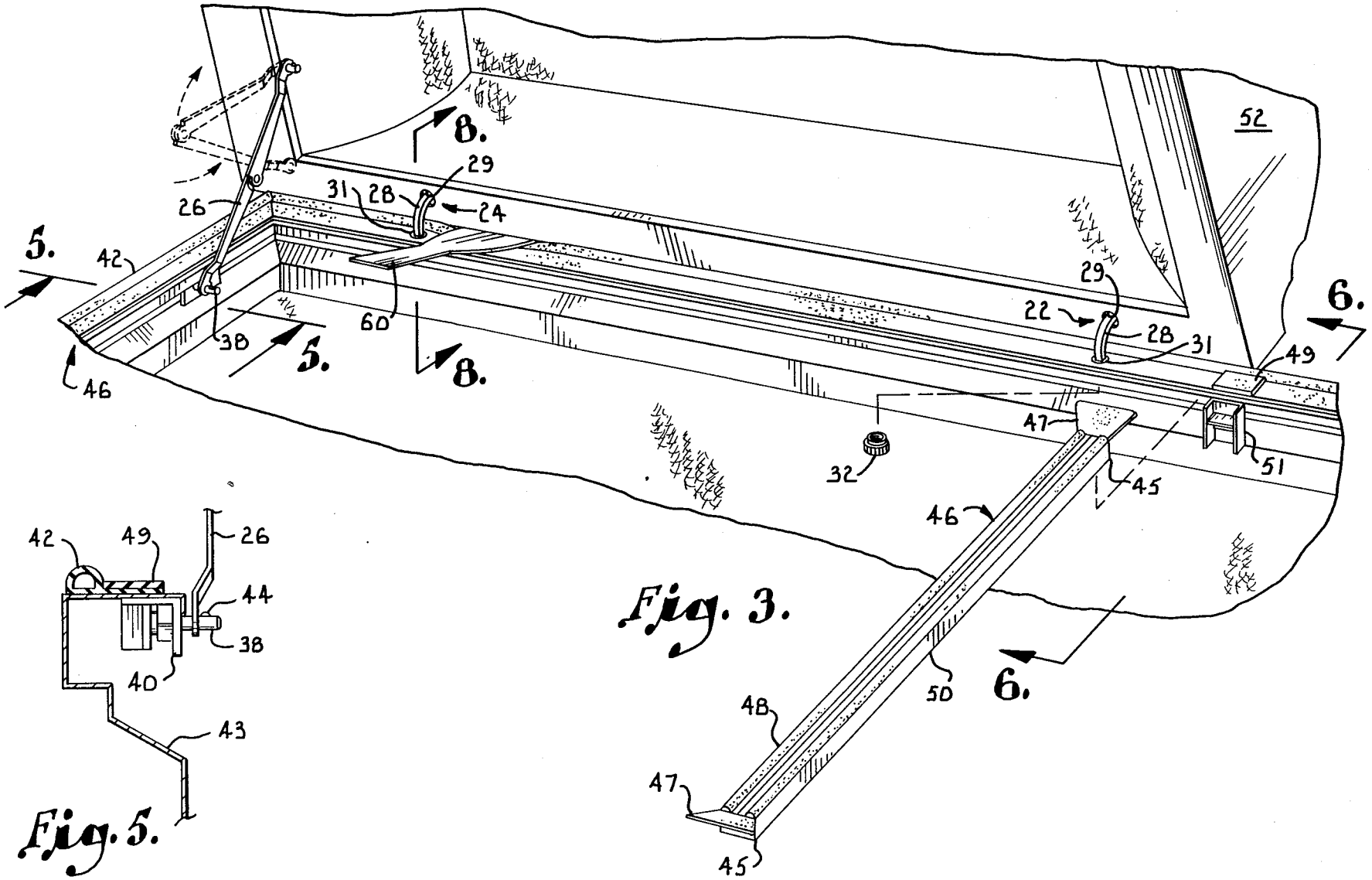
FIG. 3 is an enlarged broken away, fragmentary perspective view of the plural display casket of FIG. 1, showing the quick release mechanisms in detail.
FIG. 5 is an enlarged fragmentary cross-section taken along line 5—5 of FIG. 3, showing the quick release mechanism of the top support in more detail.
Figure 4:
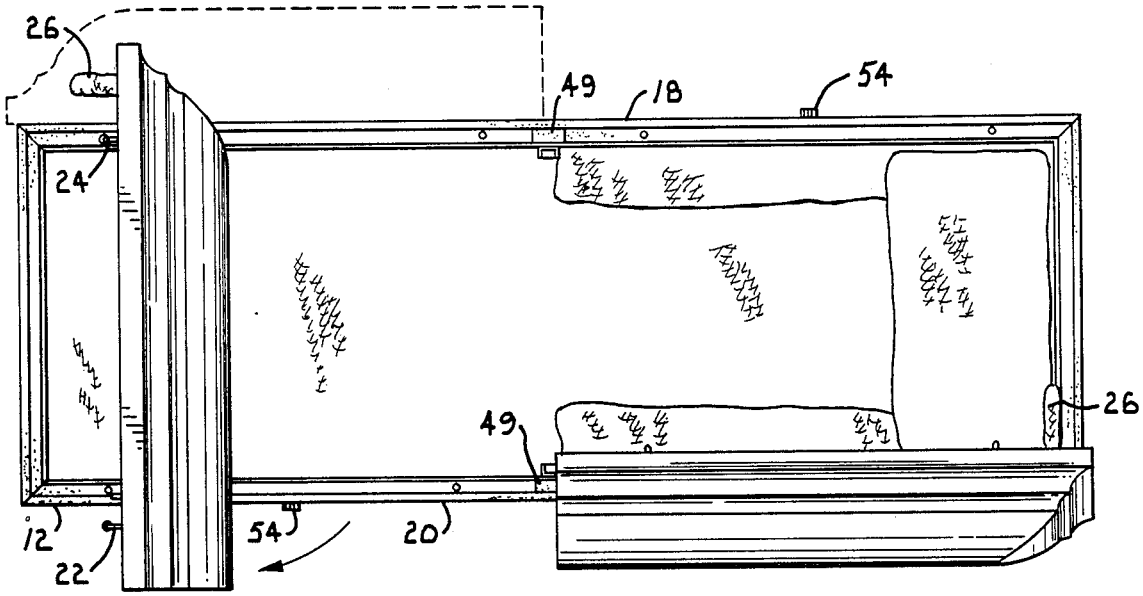
FIG. 4 is a top plan view of the plural display casket of FIG. 1 or FIG. 2, with the foot end turned perpendicular to the longitudinal axis of the casket, the phantom lines showing the unselected foot end top portion in its original opened and secured position.
Figure 6:
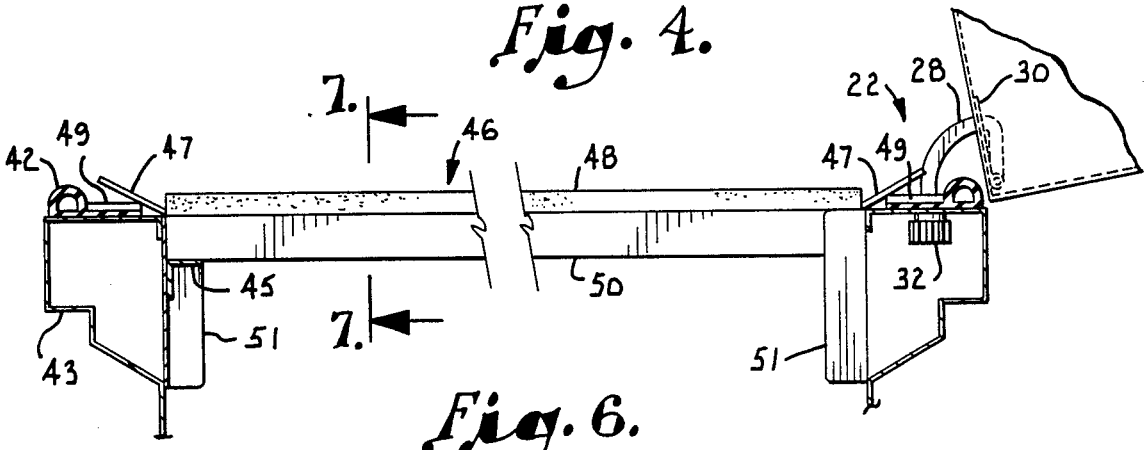
FIG. 6 is an enlarged fragmentary cross-section taken along line 6—6 of FIG. 3, showing the bridge gasket cross member and the swing hinge quick release mechanism in more detail.
Figure 7:
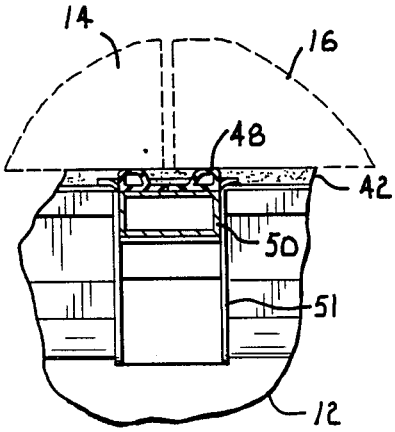
FIG. 7 is a fragmentary cross-section taken along line 7—7 of FIG. 6.

When it is desired to have a protective type casket, a gasket assembly 46 is provided as shown in FIGS. 3, 6 and 7. The gasket assembly 46 includes a main body gasket 42 lining the perimeter of the upper edge of the body portion 12, and a bridge gasket 48 positioned upon a removable bridge gasket cross member 50 which extends across the width of the structural body 12 adjacent the bridge cut at the intersection of top portions 14 and 16. When operationally positioned, the longitudinal ends 45 of the bridge gasket cross member 50 rest securely in brackets 51, and the longitudinal ends 47 of the bridge gasket 48 rest on top of bridge gasket pad 49. The bracket 51 assembly is readily apparent from the relevant cross-sectional portions of FIG. 7. The top portions 14 and 16 are each provided with a cap filler 52 that permits each of said top portions 14 and 16 to close on a common bridge gasket 48. The bridge gasket cross member 50 is positioned so that when each top portion 14 and 16 is closed and locked, the bridge gasket 48 is compressed against the cap filler 52 of each top portion 14 and 16, and ends 47 are compressed against bridge gasket pads 49.

A pair of locking mechanisms 54 are provided to secure each top portion 14 and 16 to the body portion 12. Any appropriate draw down locking mechanisms may be utilized. In the preferred embodiment, the access point to each lock is covered by a threaded and gasketed cap. In one embodiment, the lock cap on the foot end of the casket 10 is a contrasting color, and the lock cap on the head end of the casket 10 is the same color as the casket exterior. In this manner, the funeral director can know at all times which end of the burial casket 10 is the head end, precluding any possibility of the casket 10 being reversed at the grave site.

Figure 2:
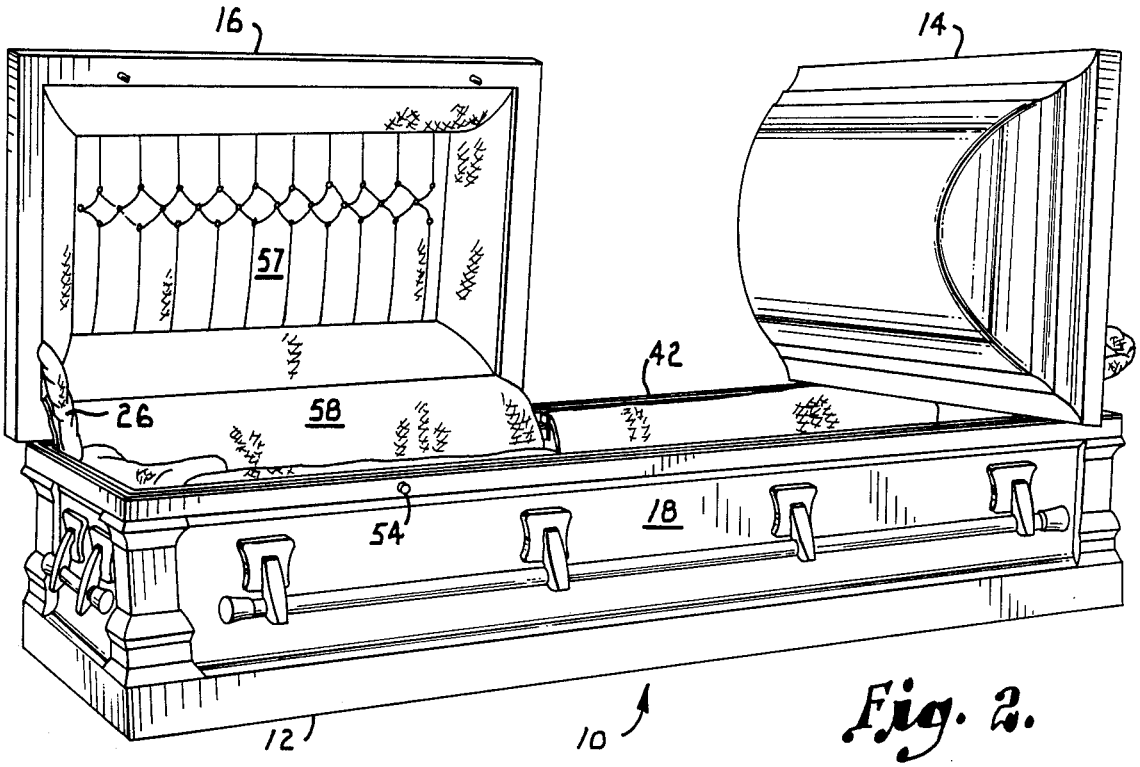
FIG. 2 is a perspective view of the plural display casket of FIG. 1, with the head and foot ends opposite of those shown in FIG. 1, the unselected foot end top portion turned perpendicular to the longitudinal axis of the casket.

Feminine interior upholstery 56 and masculine interior upholstery 57 are provided as seen in FIGS. 1 and 2, with the top portion 14 fitted with the feminine interior design 56, and top portion 16 fitted with the masculine interior design 57. The rail drop upholstery 58 is selectively removable, and can be removed to reveal the quick release mechanisms, i.e. swing hinge means 22, pivot hinge means 24 and top support means 26.

In operation, the bridge gasket cross member 50 is first removed and set aside. The rail drop upholstery 58 is then removed from the interior of the unselected foot end to expose the quick release hinge mechanisms of that end, and can be reinstalled after the body is in place if so desired. Before the swing hinge means 22 or the top support means 26 are disconnected, a device such as a plastic spatula-type tool 60 is placed adjacent to the swing hinge means 22. The tool 60 is inserted between the unselected top portion 14 or 16 and the main body gasket 42 on the body portion 12 to provide a mar free surface on which the unselected top portion 14 or 16 can turn without disturbing the position of the main body gasket 42.

The lower end of the top support 26 is detached as shown in phantom lines in FIG. 3, and manually folded up out of the way. Here, pressure is applied to depress the detent ball 44, allowing the knee brace 26 to be released from the self-locking pin 38. When the knee brace 26 is disconnected, the unselected top portion 14 or 16 must be held by hand in an upright position with the weight of the top portion 14 or 16 resting on the hinge means 22 and 24. The knurled finger nut 32 of the swing hinge means 22 is manually removed and the unselected top portion 14 or 16 is gently raised, freeing the swing hinge means 22 from the body portion 12.

The unselected top portion 14 or 16 is then turned perpendicular to the longitudinal axis of the body portion 12 where it will remain upright at rest, secured by the pivot hinge means 24. The body portion 12 is now ready to receive the body of the deceased. After the deceased is in place, the unselected top portion 14 or 16 and related components are returned to their normal positions and locked.

It is understood, of course, that the invention disclosed herein is equally applicable to all varieties of burial caskets, including protective type and non-protective type caskets (in which the gaskets are not utilized), as well as any material of construction, such as all metals, wood, paper or plastics products. Furthermore, it is to be understood that in a separate embodiment, the unselected top portion can be fully removable, if so desired.

It is to be understood that while certain forms of this invention have been illustrated and described, it is not limited thereto, except in so far as such limitations are included in the following claims.

Having thus described the invention, what is claimed as new and desired to be secured by Letters Patent is:

1. A burial casket for receiving a deceased person, said casket comprising:

a casket structural body;

a top having two substantially equal portions each having outer ends and inner ends, and a bridge cut adjacent said inner ends of said top portions defined by an elongated void extending transversely across a longitudinal axis of said structural body, each of said portions hingedly secured to said body on opposed sides thereof;

at least two hinge means attaching each of said top portions to said body, a first pivot hinge means located adjacent each of said outer ends of said top portions and a second swing hinge means located adjacent each of said inner ends of said top portions, said first hinge means adapted to allow said associated top portion to swing about the axis of said first hinge means, and said second hinge means adapted to be manually released from and resecured to said structural body; and wherein a first said top portions is selected and defines a head end of said casket, and wherein when said second swing hinge associated with a second unselected said top portion is temporarily detached from said body, said associated unselected top portion can be swung across said structural body about the axis of said first pivot hinge to a position perpendicular to the longitudinal axis of said body, and said unselected top portion can then be returned to its original, hingedly secured position.

2. The burial casket as set forth in claim 1, further comprising a top support adjacent each of said outer ends of said top portions, said top supports connecting said associated top portion with said structural body for selectively maintaining said associated top portion in an open position, said top support adapted to be manually detached from and reattached to said body.

3. The burial casket as set forth in claim 1, further comprising:

a cap filler adjacent each of said inner ends of said top portions; and a removable bridge gasket cross member extending transversely across the longitudinal axis of said body, said bridge gasket cross member having a bridge gasket thereon and positioned to sealably receive a bottom edge of both of said cap fillers.

4. The burial casket as set forth in claim 1, wherein each of said top portions are supplied with different interior upholstery styles.

5. The burial casket as set forth in claim 1, wherein each of said top portions are adapted to be attached to said body so that said selected top portion is positioned to open in a manner such that the head of a deceased within said casket is viewed at the left end of said casket.

6. A burial casket for receiving a deceased person, said casket comprising:

a casket structural body;

a top having two substantially equal portions each having outer ends and inner ends, and a bridge cut adjacent said inner ends of said top portions defined by an elongated void extending transversely across the longitudinal axis of said structural body, a first said top portion is selected and defined a head end of said casket and a second unselected said top portion defines a foot end of said casket, each of said portions hingedly secured to said structural body on opposed sides thereof;

a cap filler adjacent at each of said inner ends of said top portions;

a removable bridge gasket cross member extending transversely across the longitudinal axis of said body, said bridge gasket cross member having a bridge gasket thereon and positioned to sealably receive a bottom edge of both of said cap fillers;

at least two hinge means attaching each of said top portions to said structural body, a first pivot hinge means located adjacent each of said outer ends of said top portions and a second swing hinge means located adjacent each of said inner ends of said top portions, said first hinge means adapted to allow said associated top portion to swing about the axis of said first hinge means, and said second hinge means adapted to be manually released from and resecured to said structural body;

a top support adjacent each of said outer ends of said top portions, said top support connecting said associated top portion with said structural body for selectively maintaining said associated top portion in an open position, said top support adapted to be manually detached from and reattached to said body;

wherein when said second swing hinge associated with said unselected top portion is temporarily detached from said body, said associated unselected top portion can be swung across said structural body about the axis of said first pivot hinge to a position perpendicular to the longitudinal axis of said body, and said unselected top portion can then be returned to its original, hingedly secured position.

7. The burial casket as set forth in claim 6, wherein each of said top portions are supplied with different interior upholstery styles.

8. The burial casket as set forth in claim 6, wherein each of said top portions are adapted to be attached to said structural body so that said selected top portion is positioned to open in a manner such that the head of a deceased within said casket is viewed at the left end of said casket.

* * * * *